United States Patent [19]

Yasuda

[11] Patent Number: 4,891,915

[45] Date of Patent: Jan. 9, 1990

[54] DISK GRINDER

[75] Inventor: Shigeru Yasuda, Tokyo, Japan

[73] Assignee: Nitto Kohki Co., Ltd., Tokyo, Japan

[21] Appl. No.: 268,841

[22] Filed: Nov. 8, 1988

[30] Foreign Application Priority Data

Nov. 11, 1987 [JP] Japan ..... 62-172168[U]

[51] Int. Cl.[4] ..... B24B 23/02

[52] U.S. Cl. ..... 51/170 T; 51/268; 15/145

[58] Field of Search ..... 51/170 R, 170 T, 170 PT, 51/268; 15/145, 28, 29, 97, 257 R

[56] References Cited

U.S. PATENT DOCUMENTS 2,301,264 11/1942 Emery ..... 51/268

4,574,532 3/1986 Haberle ..... 51/268

FOREIGN PATENT DOCUMENTS 940226 10/1963 United Kingdom ..... 51/268

OTHER PUBLICATIONS

Makita Catalog, 7/1976, Models 950S and 9505B on pp. 4 and 5.

*Primary Examiner*—Roscoe V. Parker

*Attorney, Agent, or Firm*—Nixon & Vanderhye

[57] ABSTRACT

A disk grinder is of a type wherein a grinding wheel and a wheel guard for surrounding part of the grinding wheel are provided for the tip end portion of a handle. The disk grinder comprises fixing member for fixing the wheel guard to the tip end portion of the handle, a subhandle-fitting tool which can be fixed to the tip end portion of the handle together with the grinding wheel, by the fixing member, and a subhandle which is attachable/detachable from the subhandle-fitting tool.

2 Claims, 2 Drawing Sheets

DISK GRINDER

BACKGROUND OF THE INVENTION

1. Field of the Invention

The present invention relates to a disk grinder of the type which does not comprise a subhandle, and more particularly to a disk grinder comprising a mechanism for permitting easy fitting of a subhandle.

2. Description of the Related Art

Disk grinders commercially available at present are classified roughly into two types: the first type comprising a handle and a subhandle fitted on the handle, and the second type comprising only a handle.

In the case where the user must grind a given object while simultaneously pressing the disk grinder against the object, the first type is more useful since the use of the subhandle allows the grinding wheel to be stably held in a desirable direction and to be pressed very strongly against the object. This being so, some conventional disk grinders of the second type comprise a handle which is partly thickened and includes a subhandle-fitting tool provided at the thickened part. The user can fit a subhandle to the fitting tool when he wants to use it.

It is usual, however, that disk grinders which are small in size and produce relatively small torque do not comprise a subhandle. Such disk grinders are not stable during use and cannot be pressed very strongly against a given object. In addition, since the handle of such disk grinders is not very thick, it is difficult to provide a subhandle-fitting tool for the handle. Even if the user intends to provide a subhandle-fitting tool by welding or by some other method, the material of the handle may be deformed or damaged thereby. As a matter of fact, therefore, such disk grinders cannot be adapted to have a subhandle, and are hard to use in a stable manner.

SUMMARY OF THE INVENTION

The object of the present invention is to provide a disk grinder comprising a subhandle-fitting mechanism for permitting easy fitting of a subhandle.

This object is achieved by a disk grinder comprising: a handle; a grinding wheel; a wheel guard for surrounding part of the grinding wheel; a fixing member for fixing the grinding wheel to the tip end portion of the handle; a subhandle-fitting tool which can be fitted to the tip end portion of the handle, together with the wheel guard, by means of the fixing member; and a subhandle which can be removably fitted to the subhandle-fitting tool.

According to the present invention, the subhandle-fitting tool is fixed to the handle of the disk grinder by means of the same member as is used for fixing the wheel guard. The subhandle is fixed to the subhandle-fitting tool in such a manner that it extends crosswise with reference to the handle, e.g., at right angles to the handle. In case the subhandle is not necessary, it is removed from the subhandle-fitting tool.

In the disk grinder of the present invention, the subhandle-fitting tool can be fixed to the handle with the same fixing member as is used for the wheel guard. Therefore, the user can easily attach the subhandle to the disk grinder as occasion arises. After the subhandle is attached, the user can use the disk grinder in a stable manner, as in the case where a disk grinder originally having a subhandle is used.

The improvement of the disk grinder of the present invention over the prior art is attained merely by providing a space between the paired projections of a wheel guard-fastening band and preparing a subhandle-fitting tool which can be fitted in the space defined between the paired projections. Therefore, the subhandle can be made to project from the side of the handle, without requiring a high cost for the improvement.

DETAILED DESCRIPTION OF THE PREFERRED EMBODIMENTS

Figure 1:
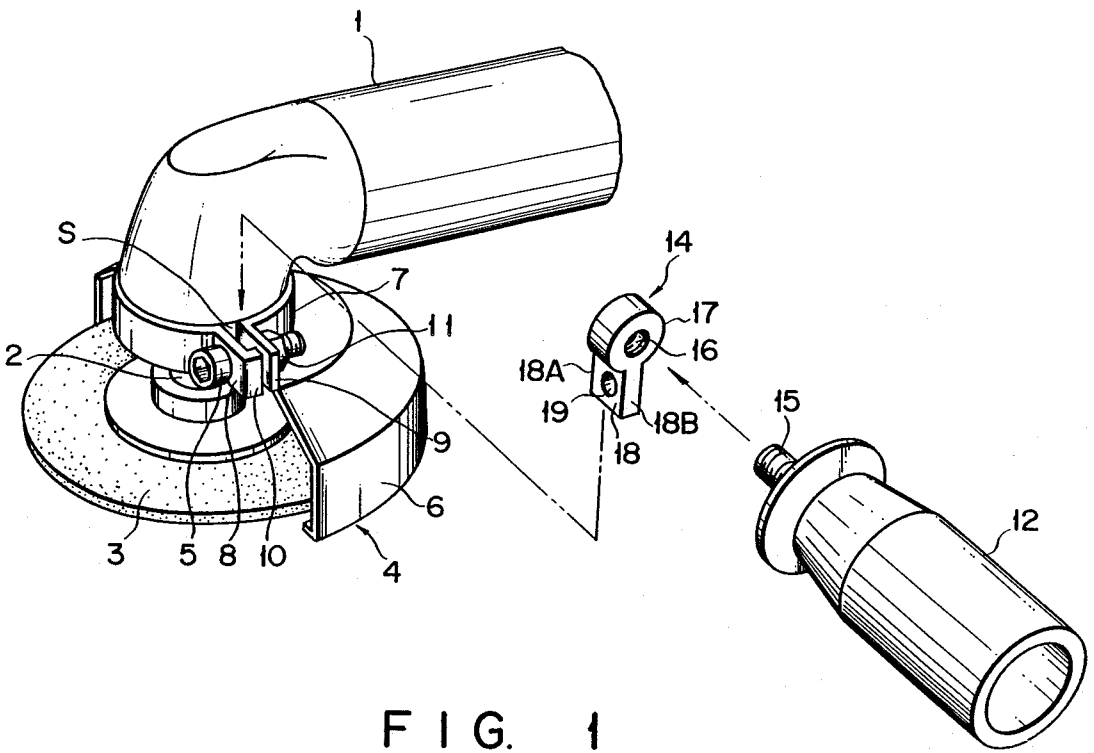
FIG. 1 is a perspective view of a disk grinder according to one embodiment of the present invention; the Figure illustrating a state where both a subhandle and its fitting tool are removed from the disk grinder.
Figure 2:
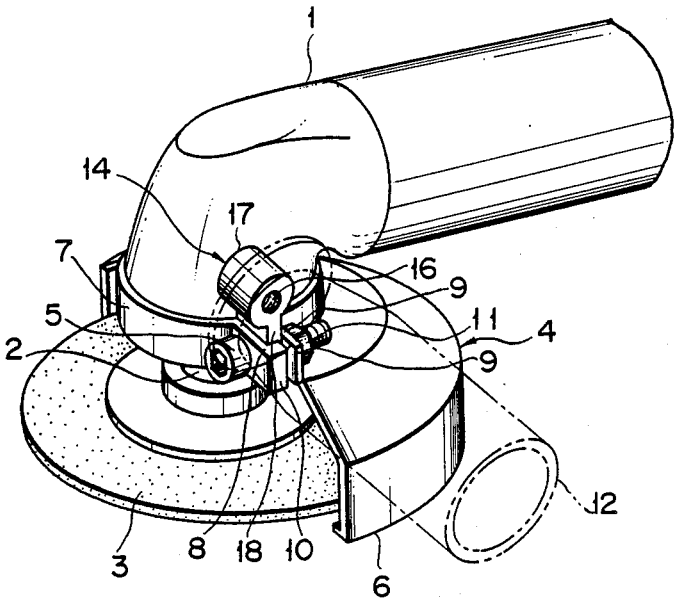
FIG. 2 is a perspective view of the same disk grinder, the Figure illustrating a state where the subhandle and the fitting tool are attached to the disk grinder.

A disk grinder according to one embodiment of the present invention will now be described. The disk grinder comprises substantially L-shaped handle 1, spindle 2 partly projected from an opening at the lower end of handle 1, grinding wheel 3 fixed to the tip end of spindle 2, and wheel guard 4 tightly secured to the tip end portion of handle 1 by means of screw 5 in such a manner as to surround part of grinding wheel 3. A drive source, such as an electric motor, an air motor, or the like, and a speed change mechanism are contained inside of handle 1.

Wheel guard 4 includes guard cover 6. Since this guard cover surrounds the upper side and outer circumference of substantially a half of grinding wheel 3, chips of an object to be ground or pieces of the abrasive coated on grinding wheel 3 are prevented from scattering toward the user. Fastening band 7 in the form of a split ring, which is to be fitted around the tip end portion of handle 1, is fixed to the upper surface of guard cover 6. Fastening band 7 includes a pair of projections 8 and 9 formed at the respective ends and projecting outwardly in the radial direction of the ring of band 7. The tip end portion of one projection (8) is bent substantially at right angles toward the other projection (9), to thereby constitute tool-holding portion 10.

Each of projections 8 and 9 has a screw hole. Screw 5 is insertable through the screw holes of projections 8 and 9 and nut 11 is threadably engageable with screw 5, so that the gap between projections 8 and 9 can be shortened by driving screw 5. Therefore, wheel guard 4 can be fixed to handle 1 by first fitting fastening band 7 around the tip end portion of handle 1 and then driving screw 5. The gap between projections 8 and 9 can be shortened by driving screw 5, as mentioned above, but space S does not fail to remain between projections 8 and 9, due to the provision of tool-holding portion 10 of projection 8. Leg 19 of subhandle-fitting tool 14, which will be explained later, is inserted into space S.

The disk grinder of the present invention is of the type which is relatively small in size and does not produce large torque, so that its handle 1 is thin and cannot be so adapted as to have a thickened part used for fitting a subhandle.

According to the present invention, therefore, subhandle 12 is fitted to handle 1 (which has no thickened part) by means of a removable type attachment, i.e., subhandle-fitting tool 14. Subhandle-fitting tool 14 includes fixing portion 17 and leg 18. Fixing portion 17 has female screw 16 engageable with male screw 15 projected from the tip end of subhandle 12. Leg 18 is a rectangular parallelepiped member whose shape is substantially the same as that of space S, and has hole 19 in the central portion thereof. Screw 5 mentioned above is inserted through hole 19.

A description will now be given as to how subhandle 12 is fitted to handle 1 by means of fitting tool 14. First of all, the user determines in which direction subhandle 12 should extend, and adjusts the position of projections 8 and 9 in accordance with the direction he has determined. Next, leg 18 of fitting tool 14 is inserted between projections 8 and 9, with screw 5 removed. Then, screw 5 is inserted into both the screw holes of projections 8 and 9 and hole 19 of leg 18. Thereafter, nut 11 is threadably fitted around screw 5. In this condition, screw 5 is driven. As the tip end portion of handle 1 is held more tightly by fastening band 7, the distance between projections 8 and 9 is gradually shortened, so that leg 18 of fitting tool 14 is clamped between projections 8 and 9. When fastening band 7 has been completely fixed to handle 1, with projections 8 and 9 extending in the direction the user determined, leg 18 is firmly held between projections 8 and 9, with the result that fitting tool 14 becomes integral with handle 1. In this condition, mail screw 15 of subhandle 12 is threadably fitted into female screw 17 of fixing portion 17 of tool 14, whereby subhandle 12 is firmly fixed to the disk grinder in the horizontal direction.

When leg 18 of fitting tool 14 is clamped and fixed between projections 8 and 9, its four side surfaces are in contact with projections 8 and 9, the side surface of handle 1, and tool-holding portion 10. Particularly, rear side surface 18A of leg 18 is in tight contact with the side surface of handle 1, and front side surface 18B of leg 18 is in tight contact with tool-holding portion 10 of projection 8. Therefore, leg 18 does not slide along projections 8 and 9 when subhandle 12 is manually supported and a moment acting with screw 5 as a center is exerted on subhandle 12. As a result, subhandle 12 is prevented from moving or slanting relative to handle 1 during use of the disk grinder.

When subhandle 12 is fitted to handle 1, it projects crosswise with reference to handle 1. Since the user can grasp both handle 1 and subhandle 12 during use of the disk grinder, he can support the disk grinder in a stable condition and he himself is in a comfortable posture. As a result, the operator can press the grinding wheel strongly against a given object. In addition, the operator can grind the object in safety and with high efficiency.

The present invention is in no way limited by the above-mentioned embodiment, and can be modified in various manners without departing from the spirit of the invention.

For example, the shape of the fitting tool is not limited to that mentioned above, and may be modified in conformity with the shapes of a fixing means and a handle to be employed. In addition, the fitting tool and the subhandle need not be fixed together by utilization of threads; they may be fixed together by providing taper surfaces for the fitting tool and the subhandle. Further, the fitting tool may be formed at the tip end portion of the subhandle in such a manner as to be integral with the subhandle. Still further, the screw for fastening the wheel guard to the handle need not be a type engageable with a nut. That is, instead of using a nut, a female screw may be formed in the projections of the fastening band, and the screw may be threadably inserted into the female screws of the projections.

What is claimed is:

1. A disk grinder wherein a grinding wheel and a wheel guard for surrounding a part of the grinding wheel are provided for a tip end portion of a handle, said disk grinder comprising:

fixing means for fixing said wheel guard to the tip end portion of said handle, a subhandle-fitting tool which can be fixed to the tip end portion of said handle together with said wheel guard, by said fixing means; and a subhandle which is attachable/detachable from said subhandle-fitting tool, said subhandle-fitting tool including a leg portion attachable to said fixing means;

said fixing means including a ring-shaped band which has at least one split section and is fitted around the tip end portion of said handle, and a pair of projections adjustably extending from the split section outwardly in a radial direction, and bolt means for fastening said pair of projections together, and said leg portion of said subhandle-fitting tool being engaged with inner side surfaces of said pair of projections and held by them, when said subhandle-fitting tool is fixed by said fixing means.

2. The disk grinder according to claim 1, wherein:

said leg portion of said subhandle-fitting tool has a substantially rectangular cross section;

one of said pair of projections includes a tool-holding portion extending toward the other projection; and said leg portion of said subhandle-fitting tool is further engaged with a side surface of the tip end portion of said handle and an inner side surface of said tool-holding portion, and held by them, when said subhandle-fitting tool is fixed by said fixing means.

* * * * *